US006151472A

United States Patent [19]

Nakajima

[11] Patent Number: 6,151,472

[45] **Date of Patent: *Nov. 21, 2000**

[54] TONER CARTRIDGE AND DRUM CARTRIDGE FOR RECEIVING THE TONER CARTRIDGE THEREIN

[75] Inventor: Shigeki Nakajima, Tokyo, Japan

[73] Assignee: Oki Data Corporation, Tokyo, Japan

[ * ] Notice: This patent is subject to a terminal disclaimer.

[21] Appl. No.: 09/447,780

[22] Filed: Nov. 23, 1999

Related U.S. Application Data

[63] Continuation of application No. 09/014,337, Jan. 27, 1998, abandoned, which is a continuation of application No. 08/592,926, Jan. 29, 1996, Pat. No. 5,722,019.

[51] Int. Cl.[7] ..... G03G 15/06

[52] U.S. Cl. ..... 399/262; 141/364; 222/DIG. 1; 399/106

[58] Field of Search ..... 399/262, 106, 399/119, 120, 103; 141/364; 222/DIG. 1, 167

[56] References Cited

U.S. PATENT DOCUMENTS

| | | | |
|---|---|---|---|
| 3,356,248 | 12/1967 | Del Vecchio | 220/213 |
| 4,629,309 | 12/1986 | Tsukano et al. | 399/257 |
| 4,696,428 | 9/1987 | Kurotaka et al. | 222/167 |
| 4,868,599 | 9/1989 | Niki | 399/35 |
| 5,078,303 | 1/1992 | Kikuchi et al. | 222/167 |
| 5,280,324 | 1/1994 | Ono et al. | 399/262 |
| 5,385,181 | 1/1995 | Bhagwat et al. | 141/364 |
| 5,486,898 | 1/1996 | Fujii | 399/112 |
| 5,506,665 | 4/1996 | Ishida et al. | 399/119 |
| 5,548,384 | 8/1996 | Weed | 399/120 |
| 5,722,019 | 2/1998 | Nakajima | 399/262 |

FOREIGN PATENT DOCUMENTS

| | | |
|---|---|---|
| 0 435 596 | 7/1991 | European Pat. Off. . |
| 0 597 507 | 5/1994 | European Pat. Off. . |
| 0 744 671 | 11/1996 | European Pat. Off. . |
| 0 773 483 A2 | 5/1997 | European Pat. Off. . |
| 57-60358 | 4/1982 | Japan . |
| 60-102666 | 6/1985 | Japan . |
| 62-035383 | 2/1987 | Japan . |
| 63-214779 | 9/1988 | Japan . |
| 6-67484 | 3/1994 | Japan . |
| 6-214461 | 8/1994 | Japan . |

*Primary Examiner*—Sophia S. Chen

*Attorney, Agent, or Firm*—Akin, Gump, Strauss, Hauer & Feld, L.L.P.

[57] ABSTRACT

A toner cartridge includes an outer pipe, inner pipe inserted into the outer pipe, and cap fitted over the inner pipe. The outer pipe and inner pipe are of a long, hollow cylinder shape and are formed with a plurality of first and second openings, respectively, therein aligned longitudinally thereof. The inner pipe has at one end thereof a toner-filling opening and an annular flange eccentric with respect to the hollow cylinder, and at the other end thereof a knob that closes the longitudinal end of the hollow cylinder and abuts the outer pipe. The first openings are not aligned with the second openings when the inner pipe is at a first rotational position and are aligned when the inner pipe is at a second rotational position. A sealing member is mounted to the inner pipe encircling the second openings and has third openings aligned with the second openings. The sealing member not only seals the gap between the inner pipe and the outer pipe but also holds the inner pipe eccentric with respect to the outer pipe. The outer pipe has at least one flange which radially outwardly extends from the outer pipe and longitudinally extends along the outer pipe. The flange has a plurality of ribs on one side thereof. The toner filling-opening has the same diameter as that of the hollow cylinder.

6 Claims, 14 Drawing Sheets

TONER CARTRIDGE AND DRUM CARTRIDGE FOR RECEIVING THE TONER CARTRIDGE THEREIN

CROSS REFERENCE TO RELATED APPLICATION

This application is a continuation of application Ser. No. 09/014,337, filed Jan. 27, 1998 now abandoned, which is a continuation of U.S. patent application Ser. No. 08/592,926 filed Jan. 29, 1996, now U.S. Pat. No. 5,722,019.

BACKGROUND OF THE INVENTION

The present invention relates to a toner cartridge structure and a drum cartridge structure for receiving the toner cartridge therein.

A prior art electrography recording apparatus will be described with reference to the drawings. FIG. 11 is a perspective view of the prior art apparatus, FIG. 12 is a partial cutaway view as seen along the lines 12 of FIG. 11, and FIG. 13 is a longitudinal cross-sectional view. A toner cartridge subassembly 31 in the figures includes an outer pipe 32, an inner pipe 37, and caps 41. The outer pipe 32 takes the form of a pipe, and has openings 33 at longitudinal opposite ends thereof and a plurality of cutouts 34 formed in each opening. The outer pipe 32 is formed with a plurality of openings 35 therein aligned longitudinally thereof. The opening 35 is for discharging toner therethrough. The outer pipe 32 has a rib 36 that extends circumferentially thereof to define the openings 35. The inner pipe 37 in the form of a hollow cylinder slidably fits into the outer pipe 32. The inner pipe 37 has openings 38 at longitudinal opposite ends, concentric with respect to the outer pipe 32. The inner pipe 37 is formed with a plurality of openings 39 therein through which toner in the inner pipe 37 is discharged when the openings 39 are aligned with the openings 35. The inner pipe 37 has two ribs 40 extending circumferentially thereof, which ribs 40 are positioned such that ribs 40 define three openings 39, side by side, with one in the middle having an opening area twice as large as the other two adjacent ones. The caps 41 and 41*a* fit to the corresponding openings 38, respectively. The cap 41*a* is formed with a toner filling hole 42 therein. The cap 41 is formed with a cross-shaped groove 56 as shown in FIG. 14B, which is not shown in FIG. 13 for simplicity of explanation. A cap 43 fits into the toner-filling hole 42. The gap between the outer pipe 32 and the inner pipe 37 is sealed by means of a sealing material, not shown. Likewise, the gap between the caps 41 and the longitudinal ends of the inner pipe 37 are sealed.

The operation of the aforementioned cartridge subassembly 31 will be described. The inner pipe 37 is slidably rotated relative to the outer pipe 32 till the openings 39 are aligned with the openings 35, thereby discharging toner in the inner pipe 37 through the aligned openings. Slidably rotating the inner pipe 37 in the reverse direction relative to the outer pipe 32 causes the openings 35 and 39 to move out of alignment with each other, thereby closing the opening 39 in the inner pipe 37 by means of the outer pipe 32.

The mounting procedure of a toner cartridge 54 including the toner subassembly 31 will now be described.

FIGS. 14A and 14B are perspective views of an essential part of the prior art apparatus, FIG. 14A showing only a left one of the two structures provided at the left and right ends of a drum cartridge 50 that receives the toner cartridge 54, and FIG. 14B showing only a left one of the two structures provided at the left and right ends of the toner cartridge 54.

A cartridge-receiving space 64 of the drum cartridge 50 includes a rotor 51 that is supported by the chassis 66 means of a hinged support and is rotatable relative to the chassis 66. The rotor 51 has a lever 52 and a cross-shaped projection 53 which are formed in one piece with the rotor 51. A projection 53 includes a long main projection 53*a* and a short sub projection 53*b*, which is perpendicular to the main projection 53*a* and formed in the middle of the main projection 53*a*. The main projection 53*a* has a first side 53*c* on its right hand side and a second side 53*d* on its left side hand. The sub projection 53*b* has a first sub projection 53*e* on its right hand side and a second sub projection 53*f* on its left hand side. The cap 41 is provided with a cross-shaped groove 56 and loosely fits over the projection 53 of the rotor 51. The groove 56 includes a main groove 56*a* and a sub groove 56*b* which is perpendicular to the main groove 56*a* at the middle of the main groove 56*a*. The main groove 56*a* has a first side wall 56*c* on its left hand side and a second side wall 56*d* on its right hand side. The sub groove 56*b* has a first sub groove 56*e* on its left hand side and a second sub groove 56*f* on its right hand side.

The operation of the prior art apparatus will now be described with reference to FIGS. 15A–15H which illustrate the mounting and dismounting operations of the prior art cartridge 54. The rotor 51 is depicted in solid line, and the cap 41 is depicted in dot-dash line. First, the lever 52 is operated to rotate the rotor 51 in the direction illustrated by arrow C as shown in FIG. 15A till the lever 52 abuts a stopper, not shown, and is then slightly operated in the reverse direction. The rotor 51 now takes up a cartridge-setting position where the cartridge 54 is to be placed in the cartridge-receiving space 64 of the drum cartridge (FIG. 15B). While being held parallel to the cartridge-receiving space 64, the cartridge 54 is lowered so that the projection 53 advances into the groove 56 of the cap 41 (FIG. 15B). The projection 53 is at an angle preventing the cartridge 54 from completely being inserted into the cartridge-receiving space 64 (FIG. 15B). Then, the cartridge 54 is further inserted into the cartridge-receiving space 64 while operating the lever 52 relative to the cap 41 slightly in the direction illustrated by arrow C as shown in FIG. 15C. The projection 53 is now in parallel to the groove 56 so that the cartridge 54 enters completely into the cartridge-receiving space 64. At this stage, the bottom of the outer pipe 32 is in close contact with a sealing member 60 of the cartridge-receiving space 64 and is exerted an upward force by the sealing member 60. Then, the lever 52 is operated to rotate the rotor 51 in the direction opposite to arrow C (FIG. 15D). While being rotated, the first sub projection 53*e* engages the sub groove 56*e* of the groove 56 which is pushed upwardly by the sealing member 60. The upward force is still acting on the cap 41 while the sub projection 53*e* engages the sealing member 60. When the rotor 51 again reaches the cartridge-setting position (FIG. 15D), the projection 53 becomes oblique to the groove 56 so that the first side 53*c* abuts the side wall 56*c*. This completes the mounting of the cartridge 54 into the cartridge-receiving space 64.

Then, the rotor 51 is rotated in the direction illustrated by arrow B till the the rotor 51 abuts a stopper, not shown, as shown in FIG. 15E. The rotation of the rotor 51 is transmitted via the projection 53 and groove 56 to the cap 41, so that the cap 41 is also rotated in the direction illustrated by arrow B. The inner pipe 37 slidably rotates in the outer pipe 32. The cartridge 54 tends to rise from the cartridge-receiving space 64 due to angular moment. However, the engagement of the first sub projection 53*e* with the first sub groove 56*e* prevents the cartridge 54 from rising. The sealing member 60 secured to the rotor 51, as shown in FIG. 14, rotates with the rotor 51 in the direction illustrated by arrow B, so that the opening 61 formed in the bottom of the cartridge-receiving space 64 is aligned with the openings 35 and 39 of the outer pipe and inner pipe to allow the toner to be dumped into the drum cartridge. This is the "open cartridge" condition.

In order to take out the cartridge 54 from the cartridge-receiving space 64, the lever 52 is operated to rotate the rotor 51 in the direction illustrated by arrow C as shown in FIG. 15F. Initially the rotor 51 alone rotates slightly relative to the cap 41 due to the loose engagement between the projection 53 and the groove 56, and a further rotation of the rotor 51 causes the second projection 53*f* to engage the second groove 56*f*. Then, the rotor 51 is still further rotated as shown in FIG. 15G in the direction indicated by arrow C till the rotor 51 abuts a stopper, not shown. In this situation, the cartridge 54 tends to rise from the cartridge-mounting space 64 due to angular moment. However, the engagement of the second sub projection 53*f* with the second sub groove 56*f* prevents the cartridge 54 from rising. The sealing member 60 in FIG. 14 rotates together with the rotor 51 in the direction illustrated by arrow C to close the opening 61 in the bottom of the cartridge-mounting space 64. The inner pipe 37 rotates relative to the outer pipe 32 in the direction illustrated by arrow C so that the openings 35 are completely out of alignment with the opening 39. This is the "closed cartridge" condition.

Finally, the lever 52 is rotated slightly in the direction illustrated by arrow B so that the second sub projection 53*f* moves out of engagement with the second sub groove 56*f* and the projection 53 is now in parallel to the groove 56 (FIG. 15H). The bottom of the cartridge-mounting space 64 still exerts an upward force on the outer pipe 32 of the cartridge, raising the cartridge 54 upwardly. Thus, the cross-shaped projection 53 moves out of engagement with the cross-shaped groove 56 allowing the cartridge 54 to be taken out of the cartridge-mounting space 64.

The aforementioned prior art cartridge is disadvantageous in that the number of parts is large, sealing means are required at both longitudinal ends, and the assembly operation is rather complex. In addition, when discharging the toner, the user must simultaneously rotate the lever 52 of the rotor 51 at both ends of the drum cartridge using both hands.

SUMMARY OF THE INVENTION

An object of the invention is to provide a toner cartridge which is simple in construction and easy to assemble.

Another object of the invention is to provide a toner cartridge where toner can be discharged by operating a knob with only one hand.

Still another object of the invention is to provide a toner cartridge/drum cartridge construction where the toner cartridge can be easily mounted to the drum cartridge.

A toner cartridge according to the present invention includes an outer pipe, inner pipe inserted into the outer pipe, and cap fitted over the inner pipe. The outer pipe is of a long pipe shape and is formed with a plurality of first openings therein aligned longitudinally thereof. The inner pipe is of a long pipe shape and has first and second longitudinal ends opposing each other. The pipe body of the inner pipe is formed with a plurality of second openings therein aligned longitudinally thereof. The first end of the inner pipe has a toner-filling opening extending longitudinally, and a first flange eccentric with respect to the pipe body, while the second end has a knob that closes the longitudinal end of the pipe body and abuts the outer pipe. The first openings are not aligned with the second openings when the inner pipe is at a first rotational position and are aligned when the inner pipe is at a second rotational position. A sealing member is mounted to the inner pipe, encircling the second openings. The sealing member not only seals the gap between the outer pipe and the inner pipe but also holds the inner pipe eccentric with respect to the outer pipe. The sealing member has third openings which are in alignment with the second openings in the inner pipe when the inner pipe is assembled into the outer pipe.

The outer pipe is provided with at least one flange which radially outwardly extends from the outer surface of the outer pipe and longitudinally extends along the outer pipe. The flange has a plurality of ribs on one side thereof. The toner-filling opening has the same diameter as that of the pipe body of the inner pipe.

The second openings are open in the direction opposite to the direction in which the first flange of the inner pipe is eccentric with respect to the pipe body. The knob is of a generally disc shape and has a part of the outer surface tapered such that the thickness of the knob decreases with the radial distance from the center of the disc shape. The knob has an outer circumferential surface concentric with respect to the outer pipe. On the outer circumferential surface is provided a mark, which is aligned with one of the flanges of the outer pipe for a proper rotational position of the inner pipe relative to the outer pipe. In the outer circumferential surface is provided with an arcuate groove along the circumferential surface. The arcuate groove loosely fits over at least one projection formed on the bottom surface of a drum cartridge into which the tone cartridge is mounted, so that the rotation of the knob is properly guided by the arcuate groove and the projection fitted thereinto.

The knob has a radially projecting lever. The lever has a first arrow and a second arrow formed thereon. The first arrow indicates the rotational direction of the lever when the toner cartridge is to be dismounted from the drum cartridge. The second arrow indicates the rotational direction of the lever when the inner pipe is to be rotated to the second rotational position to dump the toner after the toner cartridge has been received in the drum cartridge.

The cap has a conically tapered surface on a radially outer part of the top surface thereof. The cap may be made of a transparent material and graduated with, for example, in the form of a plurality of lines so that the amount of the toner in the cartridge may be inspected.

Of the plurality of second openings in the inner pipe, the openings adjacent the first and second ends are a predetermined distance, e.g., 12 mm apart from the first and second ends. The drum cartridge has a receiving portion in the form of a hollow semi-cylinder for receiving the toner cartridge. The receiving portion has first and second side walls opposing each other at longitudinal ends thereof. The receiving portion opens upwardly and extends longitudinally. The receiving portion has opposed first and second side walls at opposed ends.

BRIEF DESCRIPTION OF THE DRAWINGS

FIG. 8A1 illustrates a side wall of an essential part of the drum cartridge shown in FIG. 8A.

FIG. 8A2 illustrates a side wall of an essential part of the drum cartridge opposite the side wall illustrated in FIG. 8A1.

DETAILED DESCRIPTION OF THE PREFERRED EMBODIMENTS

Figure 1:
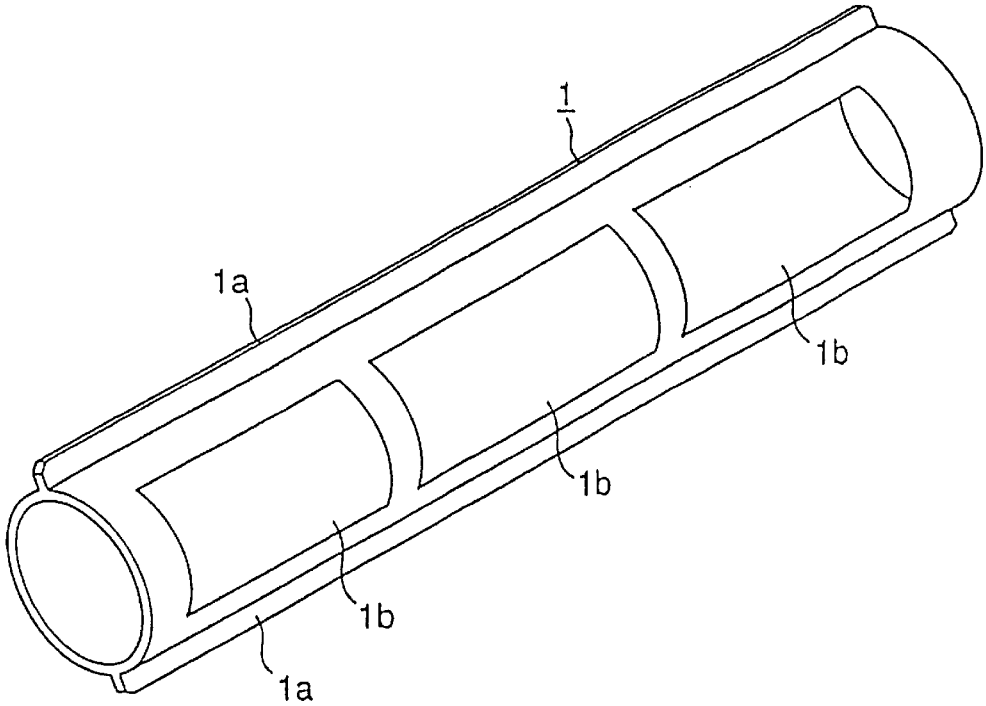
FIG. 1 is a perspective view of an outer pipe of a toner cartridge of the invention.
Figure 6:
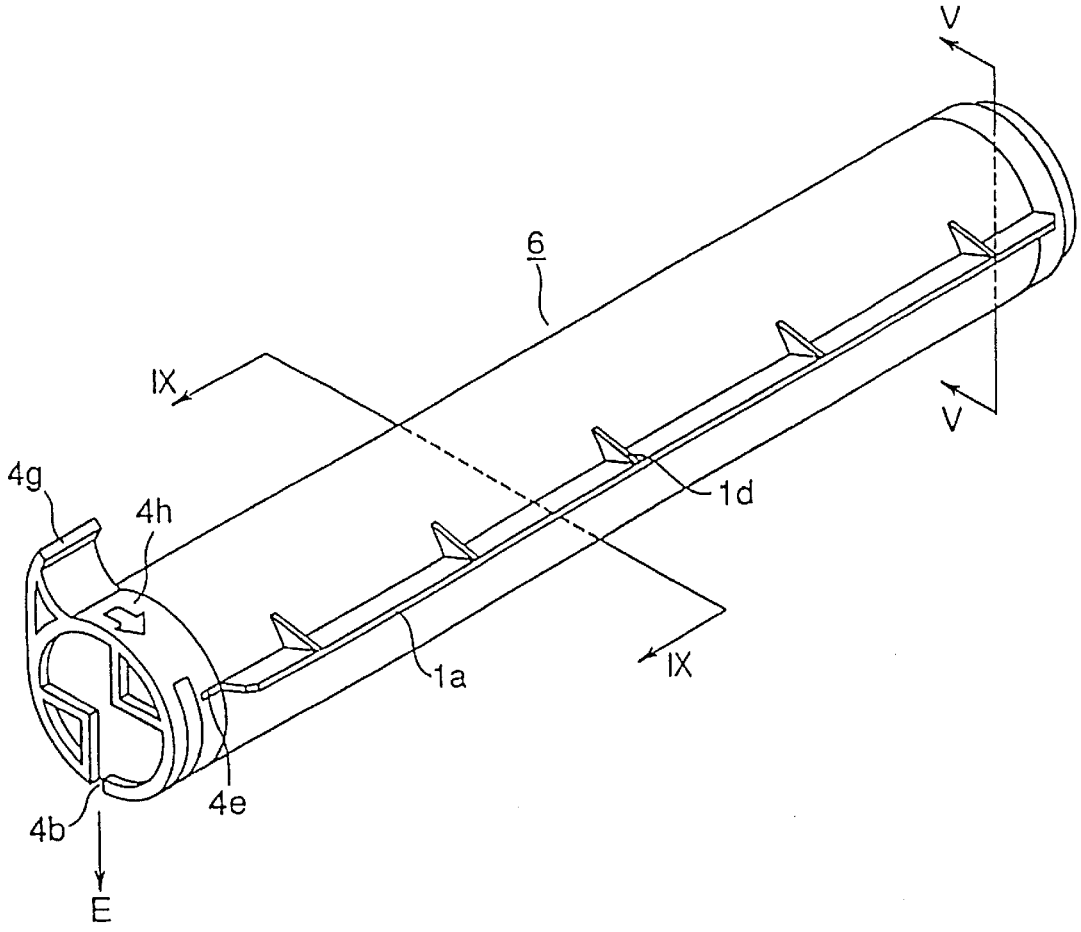
FIG. 6 is a perspective view of the assembled toner cartridge of the invention.

FIG. 1 is a perspective view of an outer pipe 1 of a toner cartridge of the invention. The outer pipe 1 is generally of a cylindrical shape having a small thickness, and opens at longitudinal opposed ends. The outer pipe 1 has two flanges 1*a* that prevent the toner cartridge 6 from rotating when mounting the toner cartridge 6 into the drum cartridge 7, and three openings 1*b* through which the toner is dumped into the drum cartridge 7. The flanges 1*a* are provided at diametrically opposed positions and extend longitudinally of the outer pipe 1. On one side of each flange are provided a plurality of ribs 1*d* along the outer pipe as shown in FIG. 6. The openings 1*b* are aligned longitudinally of the sleeve.

Figures 2A, 2B:
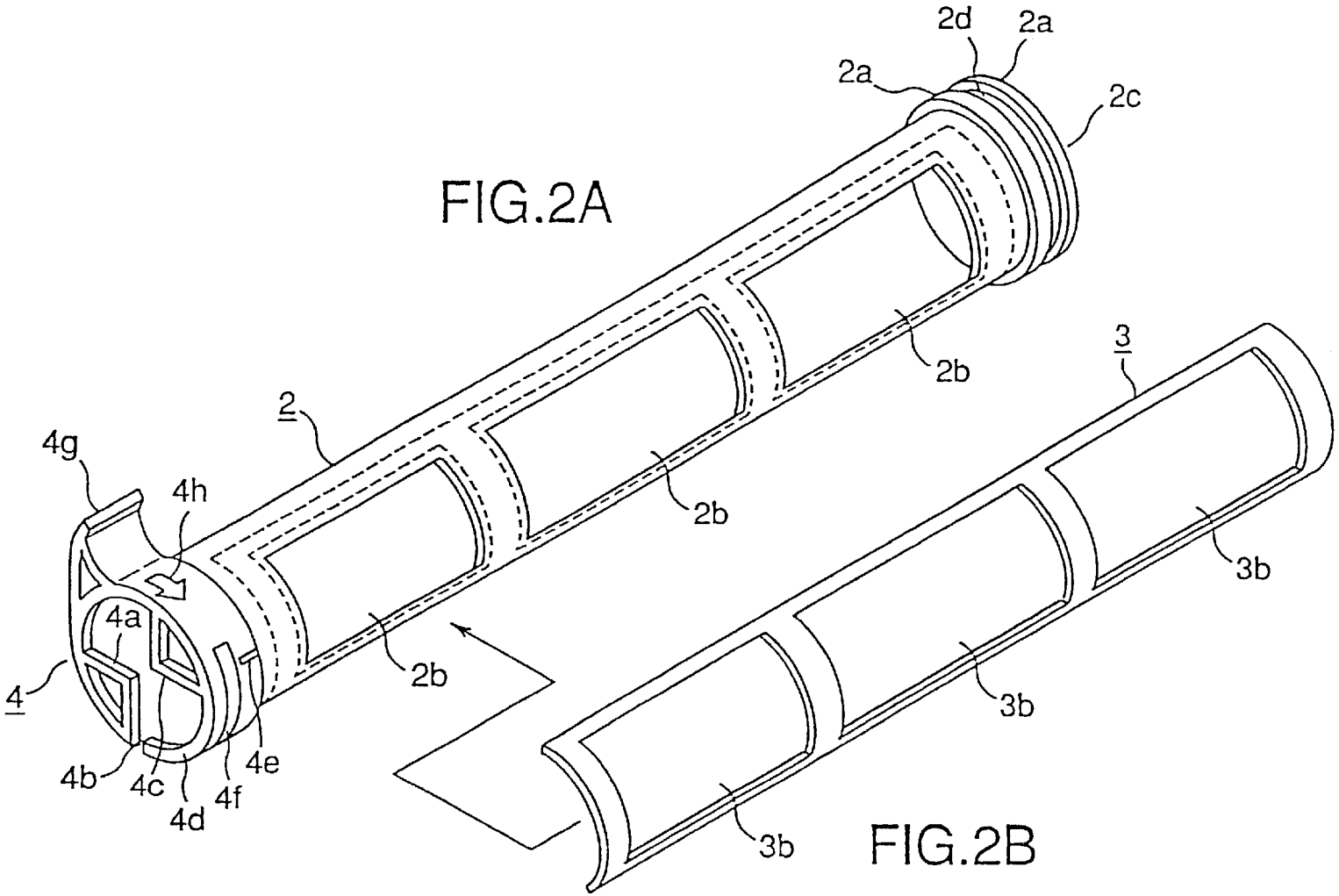
FIG. 2A is a perspective view of an inner pipe of the toner cartridge of the invention.
FIG. 2B is a perspective view of a sealing member.
Figure 4A:
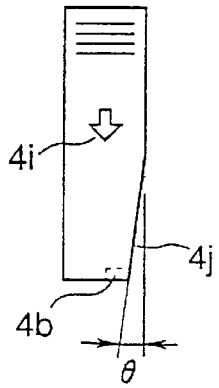
FIGS. 4A–4B illustrate the side of a knob.
Figure 4B:
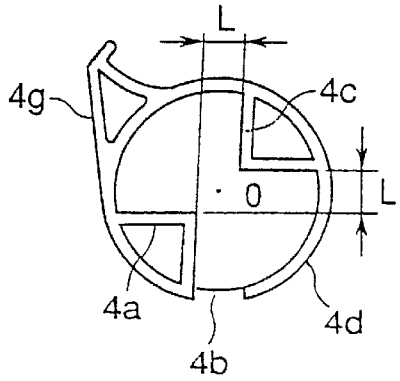
Figure 5A:
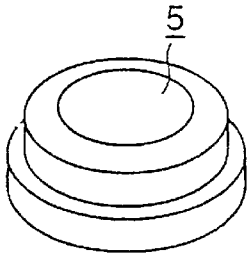
FIG. 5A is a perspective view of a cap.

FIG. 2A is a perspective view of an inner pipe 2 of the toner cartridge of the invention. The inner pipe 2 is of a generally cylindrical shape having a small thickness and a diameter smaller than the inner diameter of the outer pipe 1. The inner pipe 2 has a toner-filling opening 2*c* that opens at a first longitudinal end thereof, and a knob 4 that closes the inner pipe at a second end opposing the first end. The inner pipe 2 has two flanges 2*a* that are eccentric with respect to the pipe body of the inner pipe and has a slightly larger outer diameter than that of the pipe body. The two flanges define a circumferential groove 2*d* therebetween. After the inner pipe 2 has been filled with toner therein, a cap 5 shown in FIG. 5A is fitted over the toner-filling opening 2*c* to close the opening 2*c*. The maximum outer diameter of the cap 5 is as large as that of the outer pipe 1. In the middle of the inner pipe 2 are provided three openings 2*b* that are aligned longitudinally of the inner pipe and are open in a direction opposite to a direction in which the flanges 2*a* are eccentric with respect to the pipe body. The outer circumferential surface of the knob 4 has a diameter larger than the outer diameter of the inner pipe but the same as the outer diameter of the outer pipe 1. The openings immediately adjacent the opposed longitudinal ends are arranged not too far from the longitudinal ends, preferably 12 mm, equal to a width of a later described sealing member 3, so that toner is not left in the inner pipe after the toner has been dumped into the drum cartridge 7. The knob 4 is formed with a circumferential groove 4*f* therein along the circumferential surface, and an arrow 4*h* indicative of the direction in which the knob 4 is to be rotated. The groove 4*f* guides the rotation of the knob 4 when the toner is discharged from the toner cartridge 6 into the drum cartridge 7. The knob 4 has a mark 4*e* in the form of a low projection arranged in the middle of the opening 2*b* as shown in FIG. 2B. FIGS. 4A–4B illustrate the knob 4. The knob 4 has a radially projecting lever 4*g*, which has an arrow 4*i* provided thereon indicative of the rotational direction of the knob 4. The knob 4 is formed with a circumferential wall 4*d* that extends along the circumference of the disc shape of the knob 4. The circumferential wall 4*d* has a cutout 4*b* therein. Generally L-shaped ribs 4*a* and 4*c* are symmetrical with respect to the center of the disc shaped knob 4 and are inscribed in the circumferential wall 4*d*. The straight portions of the rib 4*a* are parallel to the straight portions of the rib 4*c* and are a predetermined distance L apart as shown in FIG. 4B. The rib 4*a* is immediately adjacent to the cutout 4*b*. As shown in FIG. 4A, the knob 4 has a tapered or chamfered part 4*j* at an angle θ on the side thereof such that the thickness of the knob 4 decreases toward the cutout 4*b*. The taper 4*j* facilitates insertion of the toner cartridge 6 into the drum cartridge 7.

FIG. 2B is a perspective view showing a sealing member 3. The sealing member 3 is formed of a resiliently deformable material such as urethane, sponge, felt, or the like, and has a thickness slightly larger than the gap between the inner and outer pipes, as shown in FIGS. 9A–9D, between the inner pipe 2 and the outer pipe 1. The openings 3*b* in the sealing member 3 are slightly larger than the openings 2*b*. The sealing member 3 is bonded to the inner pipe 2 by means of, for example, a double sided bonding tape is such a way that the openings 3*b* are aligned with the openings 2*b*. The sealing member 3 seals the gap between the inner pipe 2 and the outer pipe 1 upon assembling the inner pipe 2 into the outer pipe 1, preventing the toner from leaking from the inner pipe 2. The sealing member 3 causes the inner pipe 2 to be eccentric with respect to the outer pipe and frictionally holds the inner pipe 2 in position relative to the outer pipe 1.

Figure 3:
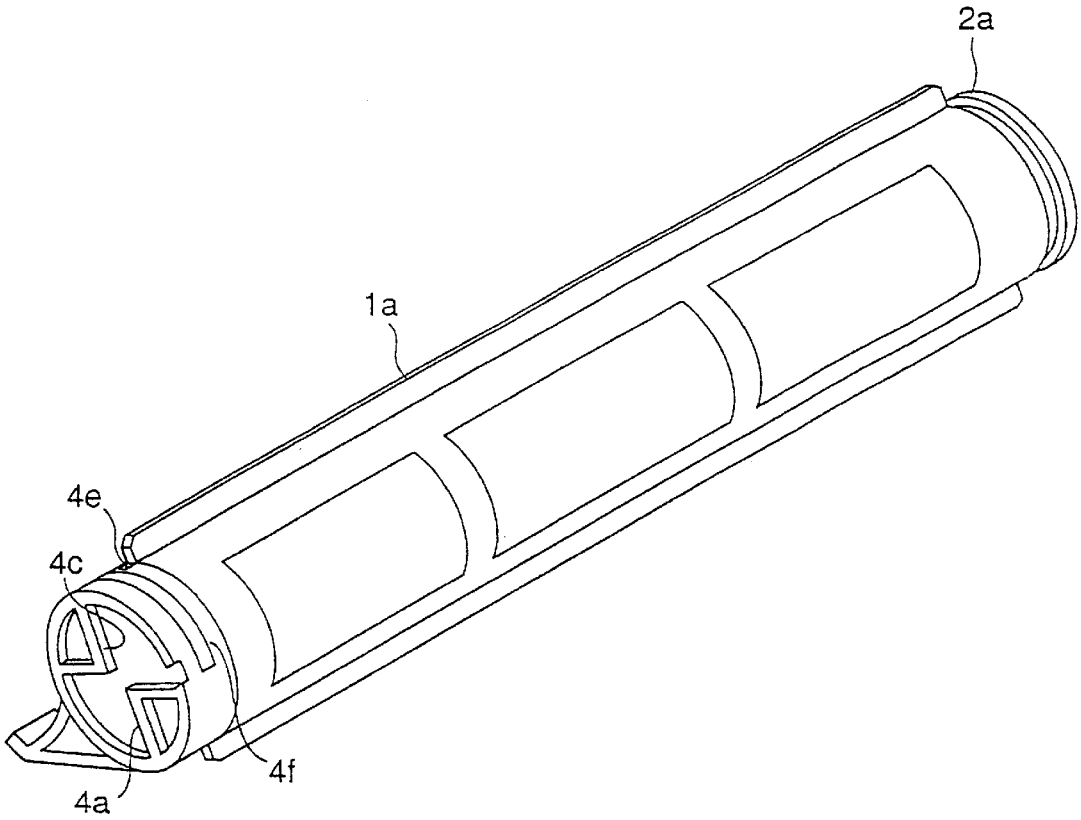
FIG. 3 illustrates the inner pipe inserted into the outer pipe.

FIG. 3 illustrates the inner pipe 2 inserted into the outer pipe 1. The inner pipe 2 is rotated so that the mark 4*e* on the knob 4 is in alignment with the flange 1*a* of the outer pipe 1 where the openings 2*b* are completely closed by the outer pipe 1 and the openings 1*b* are completely closed by the inner pipe 2, thereby properly sealing the gap between the inner pipe and the outer pipe. The side of the knob 4 serves as a stopper against the axial movement of the outer pipe 1 relative to the inner pipe 2.

Figure 9A:
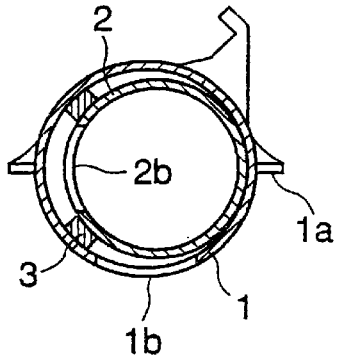
FIGS. 9A–9B illustrate the relative rotational positions of the inner pipe and outer pipe.
Figure 9B:
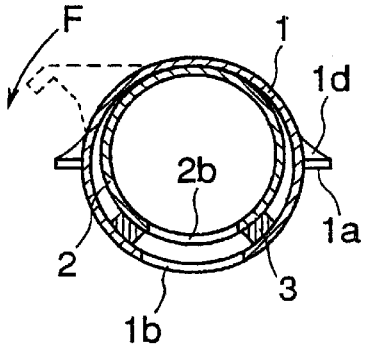
Figure 10:
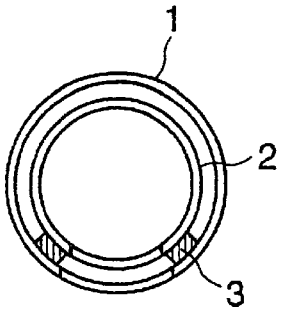
FIG. 10 illustrates an inner pipe concentric with respect to an outer pipe.
Figure 11:
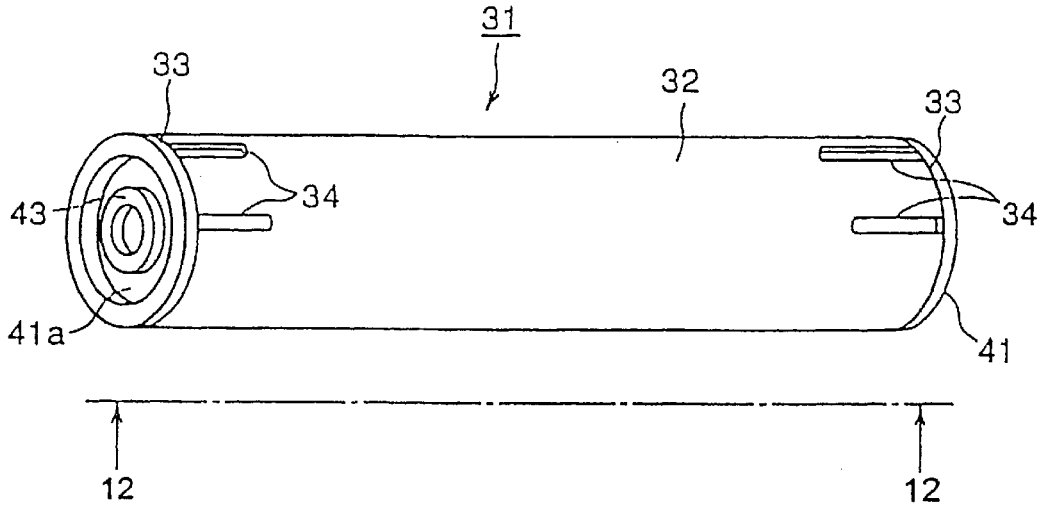
FIG.11 PRIOR ART
FIG. 11 is a perspective view showing the prior art.
Figure 12:
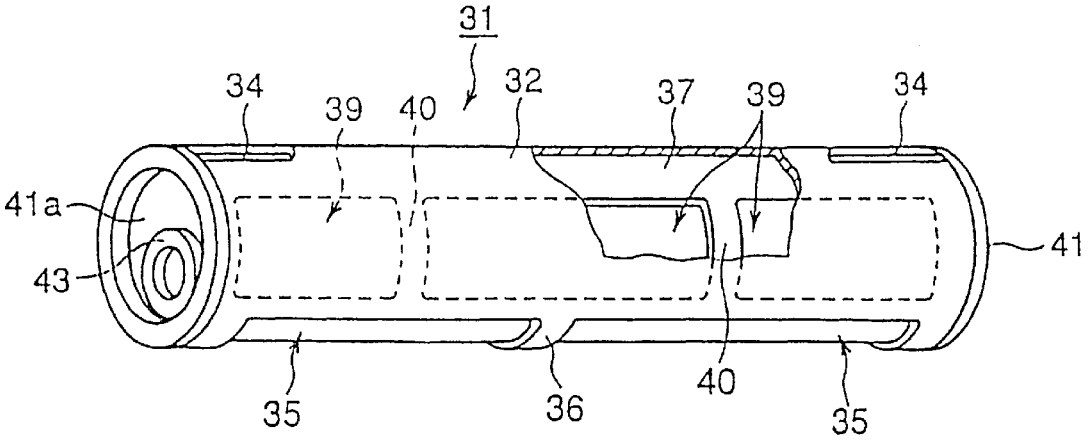
FIG.12 PRIOR ART
FIG. 12 is a perspective view, partly cut away, as seen in the direction of arrow 12.
Figure 13:
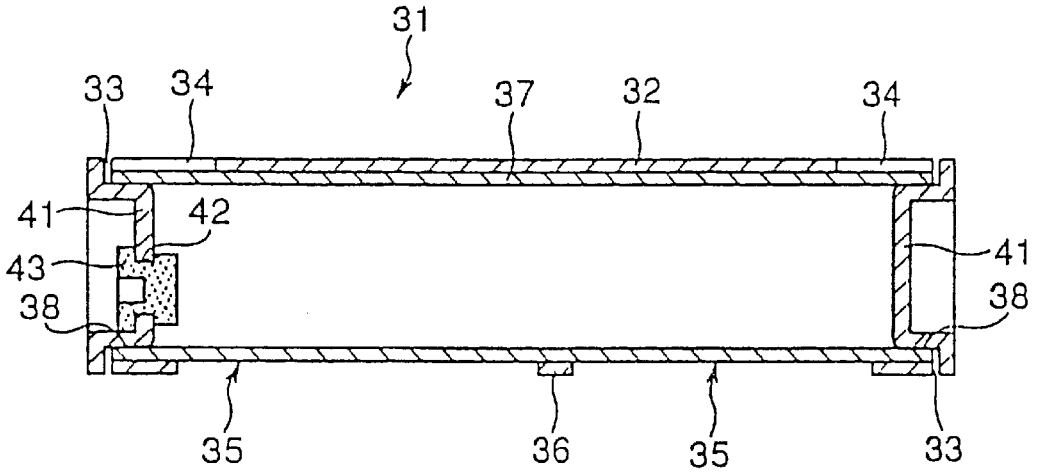
FIG.13 PRIOR ART
FIG. 13 is a longitudinal cross-sectional view of a prior art toner cartridge.
Figure 14A:
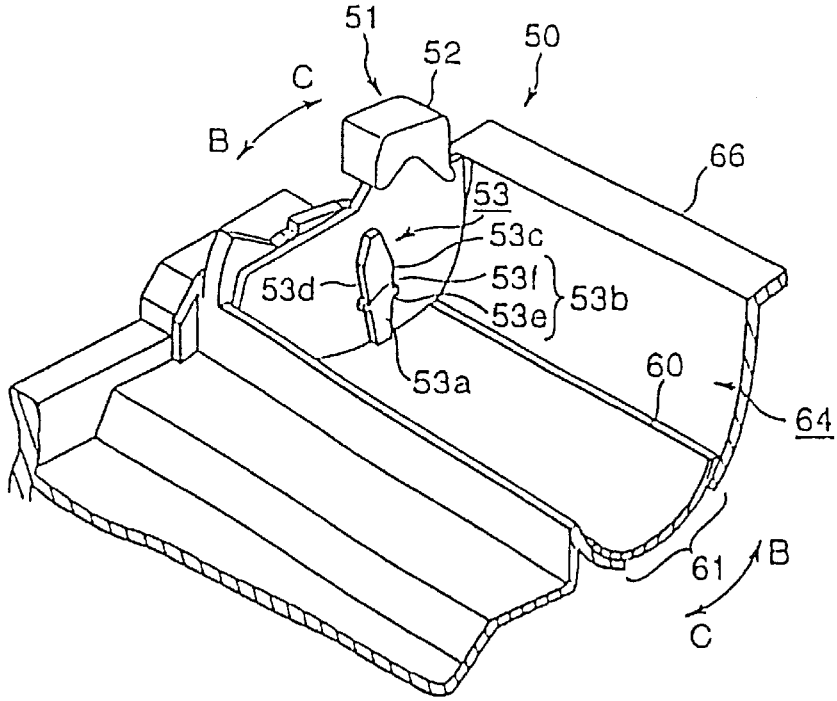
FIG.14A PRIOR ART
FIG. 14A is a perspective view of an essential part of a prior art drum cartridge.
Figure 14B:
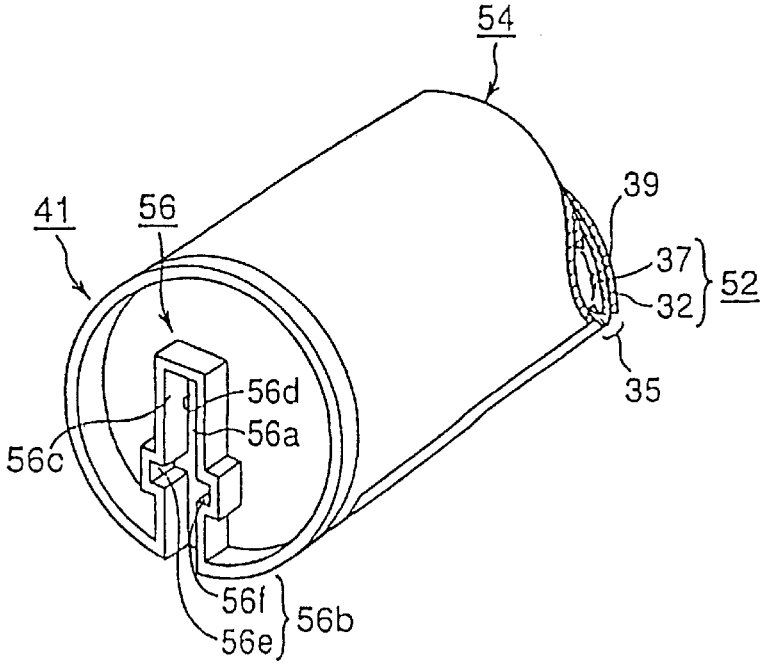
FIG.14B PRIOR ART
FIG. 14B is a perspective view of an essential part of the prior art toner cartridge.
Figure 15A:
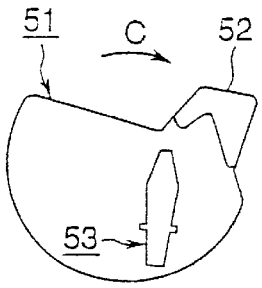
FIG.15A PRIOR ART
FIGS. 15A–15H are illustrative diagrams showing the mounting and dismounting operations of the prior art toner cartridge.
Figure 15B:
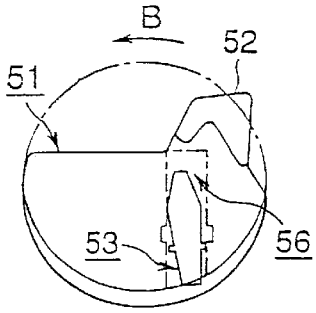
FIG.15B PRIOR ART
Figure 15C:
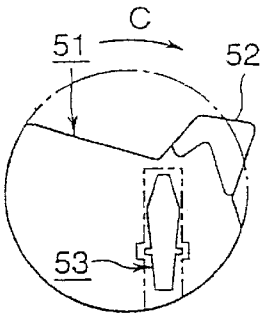
FIG.15C PRIOR ART
Figure 15D:
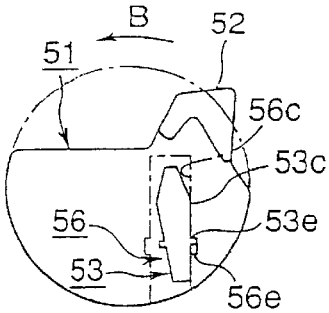
FIG.15D PRIOR ART
Figure 15E:
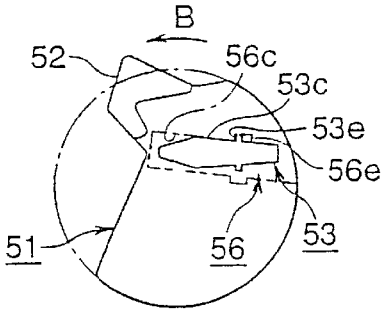
FIG.15E PRIOR ART
Figure 15F:
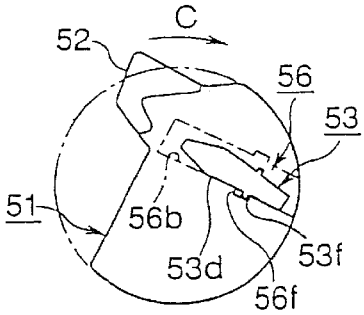
FIG.15F PRIOR ART
Figure 15G:
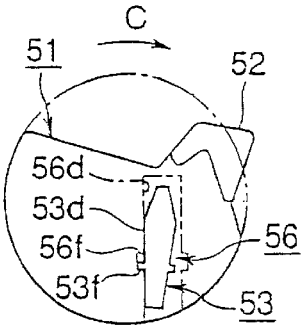
FIG.15G PRIOR ART
Figure 15H:
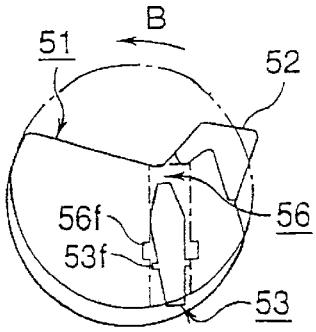
FIG.15H PRIOR ART

FIG. 6 is a perspective view of the completely assembled toner cartridge with the inner pipe filled with the toner. Since the maximum outer diameter of the cap 5 is the same as that of the outer pipe 1, the cap 5 serves as a stopper against the axial movement of the outer pipe 1 once the cap 5 has been fitted over the toner filling opening 2*c*. Thus, the inner pipe 2 is frictionally rotatable relative to the outer pipe 1 but is unable to move axially relative to the outer pipe. FIG. 9A is a cross-sectional view taken along lines IX—IX of FIG. 6. In the present invention, the pipe body of the inner pipe 2 is eccentric with respect to the outer pipe 1 so that the the outer circumferential surface of the inner pipe 2 diametrically opposite to the openings 2*b* is urged against the inner wall of the outer pipe 1 upon completion of assembly. Thus, the flange 2*a* eccentric with respect to the pipe body of the inner pipe 2, is concentric with respect to the outer pipe 1. For the same inner diameter of an outer pipe, a toner-accommodating space can have a larger inner diameter in an inner pipe eccentric with respect to the outer pipe shown in FIGS. 9A–9B than in an inner pipe concentric with respect to an outer pipe as shown in FIG. 10. The resultant larger inner diameter provides a larger toner-accommodating space. With the construction shown in FIG. 10, the urging force exerted on the inner pipe 2 by the outer pipe via the sealing member 3 can cause the inner pipe to deflect in the middle thereof. In the present invention, the inner pipe 2 receives a force from the outer pipe 1 via the sealing member 3 and another force directly from the outer pipe 1. These two forces are equal in magnitude and opposite in direction, preventing the inner pipe 2 from deflecting in one direction during prolonged storage of the toner cartridge 6.

Figure 5B:
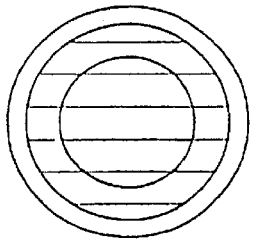
FIG. 5B illustrates a modification of the cap.
Figure 5C:
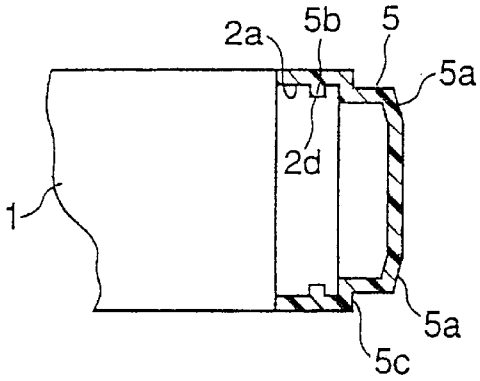
FIG. 5C is a cross-sectional side view of the cap fitted over the inner pipe taken along lines V—V in FIG. 6.

FIG. 5C is a cross-sectional side view of the cap fitted over the inner pipe 2, taken along lines V—V in FIG. 6. The cap 5 is formed of a resilient material such as rubber. As is apparent from FIG. 5C, the cap 5 has an inwardly projecting annular projection 5*b* which fits into a groove 2*d* in the inner pipe 2 with a snap action when forcibly fitted over the toner-filling opening 2*c*. The outer diameter of the cap 5 is the same as that of the outer pipe 1. The cap 5 has a conically tapered surface 5*a* on a radially outer part of the top surface thereof, the tapered surface facilitating the mounting of the toner cartridge 6 into the drum cartridge 7.

Figure 7A:
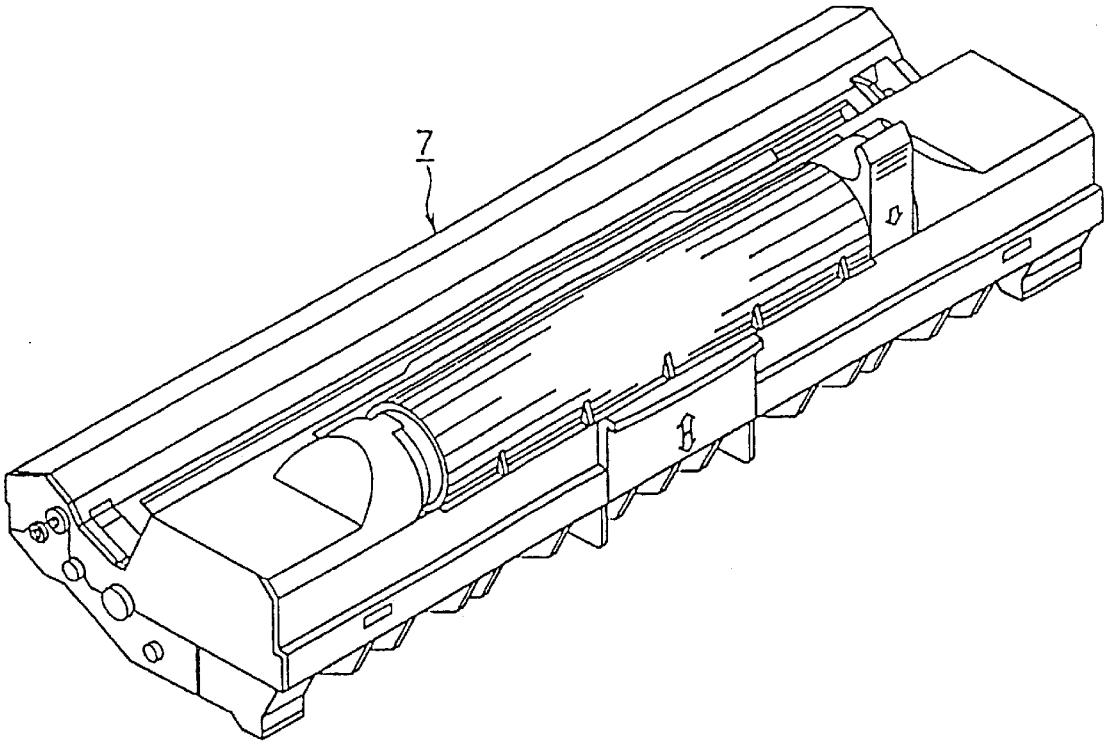
FIG. 7A illustrates the toner cartridge received in a drum cartridge.
Figure 7B:
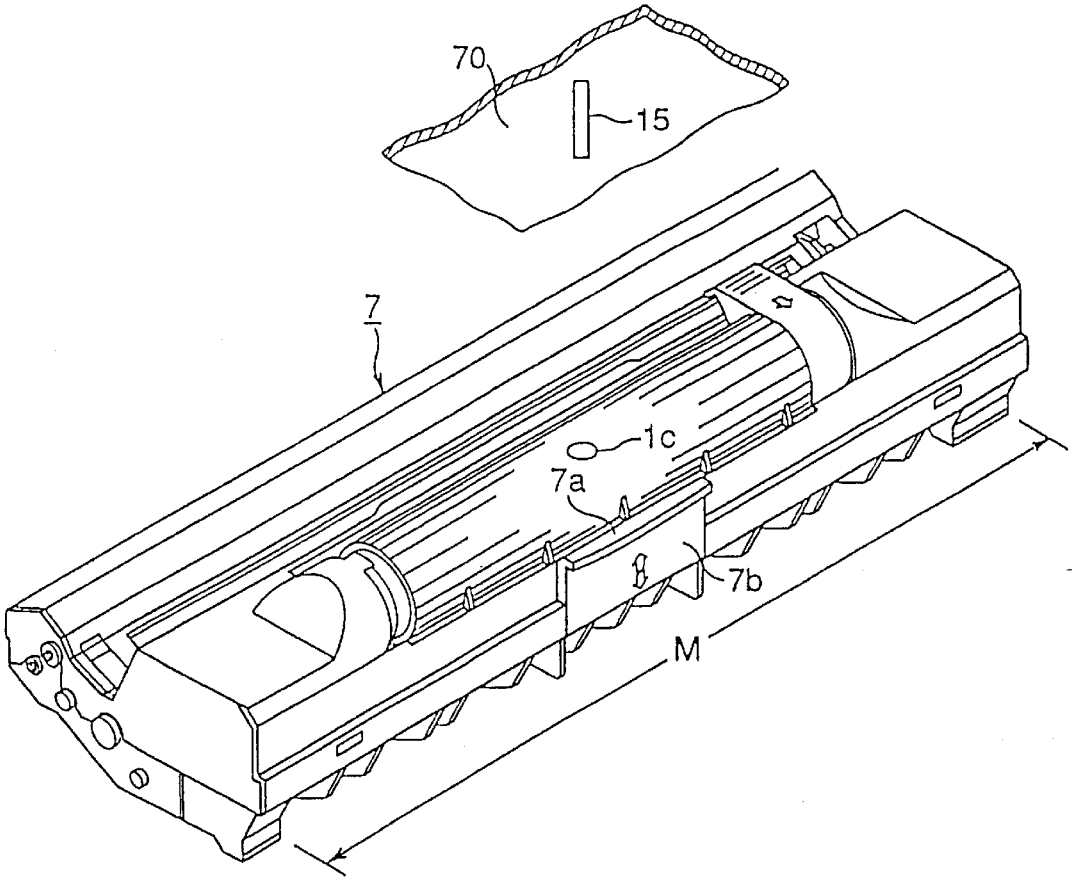
FIG. 7B illustrates the knob fully rotated from the position in FIG. 7A.
Figure 7C:
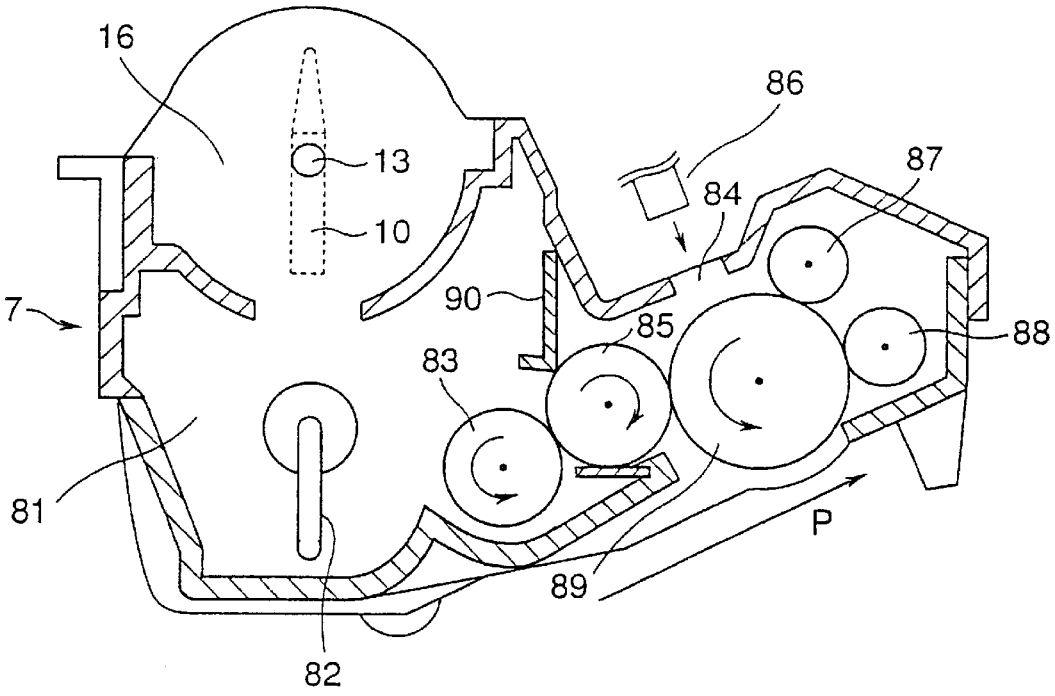
FIG. 7C illustrates a drum cartridge of the invention in detail.
Figure 8A:
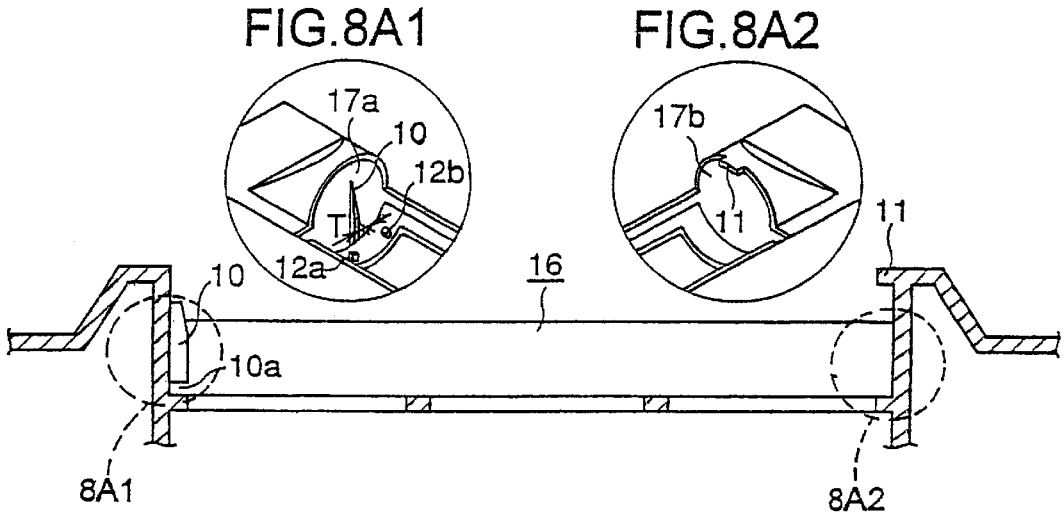
FIG. 8A illustrates the essential part of the drum cartridge shown in FIGS. 7A and 7B.

As shown in FIG. 8A, the drum cartridge 7 has a receiving portion 16 in the form of a hollow semi-cylinder having a semi-circular cross section for receiving the toner cartridge 6 therein. The receiving portion 16 opens upwardly and extends longitudinally. The receiving portion 16 has first and second side walls 17*a* and 17*b* located at opposed longitudinal ends shown in greater detail in FIGS. 8A1 and 8A2 respectively. The first side wall 17*a* is formed with a vertically extending projection 10 thereon which is a predetermined distance apart from the bottom of the receiving portion leaving a small space 10*a* under the projection 10. The width T of the projection 10 is selected to be smaller than the distance L between the ribs 4*a* and 4*c*. On the bottom of the receiving portion 16 near the projection 10 are provided two upward projections 12*a*, 12*b*. On the upper end of the second side wall 17*b* is provided with a laterally extending projection 11, which engages a step 5*c* of the cap 5 upon mounting the toner cartridge 6 into the receiving portion 16 to thereby prevent the toner cartridge 6 from moving out of the receiving portion 16. FIG. 7C shows the drum cartridge 7 in detail. Referring to FIG. 7C, a toner receiving space 81 is immediately below the receiving portion 16. The toner receiving space 81 houses a toner supplying roller 83 and a stirring bar 82 which is rotated to stir the toner so that the toner is distributed evenly in the toner receiving space 81. The developing roller 85 is rotated in contact with the toner supplying roller 83. A developing blade 90 operates to deposit the toner layer of a predetermined thickness on the developing roller 85. The developing roller 85 rotates in contact with the photosensitive drum 89 to deposit the toner layer on the photosensitive drum 89. A charging roller 87 and cleaning roller 88 are rotated in contact with the photosensitive drum 89. A recording medium such as paper travels below the drum cartridge 7 in the direction of arrow P. An LED head 86 enters the drum cartridge 7 through a hole 84 and opposes the photosensitive drum 89. The LED head 86 selectively illuminates the surface of the photosensitive drum 89 in accordance with the information received from the main part of the electrography recording apparatus, not shown, so as to form an electrostatic latent image on the surface of the photosensitive drum.

Figure 8B:
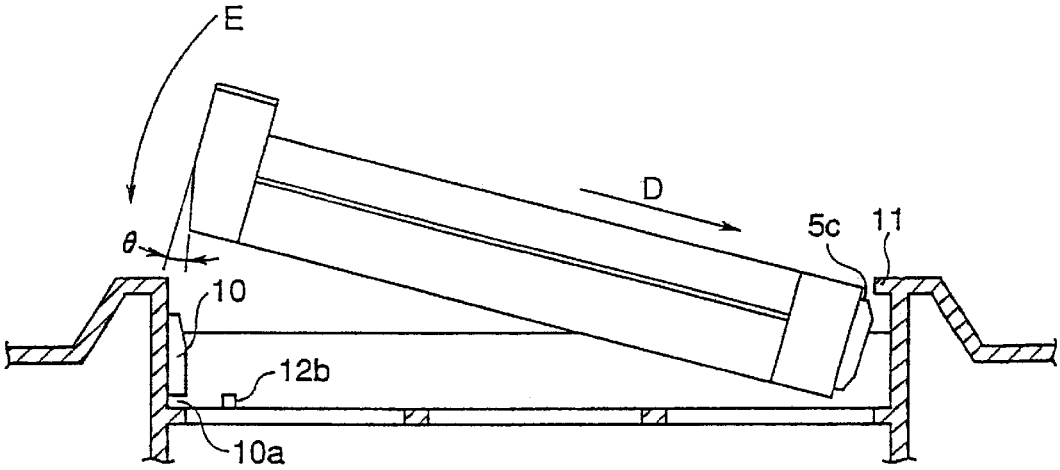
FIG. 8B illustrates the procedure for mounting the toner cartridge into the drum cartridge.

The operations for mounting the toner cartridge 6 into the drum cartridge 7 and for discharging the toner from the toner cartridge 6 will be described with reference to FIGS. 8A–8B and FIG. 6. First, the toner cartridge 6 is held in a position as shown in FIG. 6 with respect to the drum cartridge 7. Then, as shown in FIG. 8B, the toner cartridge 6 is inserted in the direction of arrow D into the receiving portion of the drum cartridge 7 so that the cap 5 enters under the projection 11. Then, the toner cartridge 6 is gently inclined about the cap 5 in the direction of arrow E so that the the projection 10 of the drum cartridge 7 enters the gap between the ribs 4*a* and 4*c* through the cutout 4*b*. The taper 4*j* of the knob 4 facilitates the smooth entering of the ribs 4*a*, 4*c* into the drum cartridge 7. Upon inclining the toner cartridge 6 fully in the direction illustrated by arrow E, the two flanges 1*a* of the outer pipe 1 are seated on the longitudinally extending edges of the receiving portion 16, and the projections 12*b* on the bottom of the receiving portion 16 loosely fits into the arcuate groove 4*f* in the knob 4. Thus, the toner cartridge is comfortably seated in the drum cartridge 7 as shown in FIG. 7A. At this stage, the inner pipe 2 is in a positional relation as shown in FIG. 9A with the outer pipe 1. The projections 12*b* loosely fitted into the groove 4*f* serve to smoothly guide the knob 4 when the knob 4 is rotated in order to discharge the toner. When the toner cartridge 6 has been completely received in the receiving portion 16, the step 5*c* of the cap 5 engages the projection 11 and the outer surface of the tone cartridge 6 is flush with the projection 11. Then, operating the lever 4*g* to rotate the knob 4 in the direction illustrated by the arrow 4*h* (direction F in FIG. 9B) causes the circumferential wall 4*d* to enter the space 10*a* under the projection 10, preventing the toner cartridge 6 from rising up. The rotation of the knob 4 causes the inner pipe 2 to frictionally rotate relative to the outer pipe 1. The two flanges 1*a* seated on the drum cartridge 7 hold the outer pipe 1 in position, preventing the outer pipe 1 from rotating together with the inner pipe 2 when dumping the toner into the drum cartridge. Even if the toner cartridge 6 has been filled with toner therein with the inner pipe aligned at the wrong position relative to the outer pipe, the ribs 1*d* on one side of the flanges 1*a* abuts the longitudinal edges of the receiving portion 16 before the flanges 1*a* are comfortably seated on the longitudinal edges, preventing further insertion of the toner cartridge 6 into the receiving portion 16. This prevents an accidental opening of the toner-discharging opening with the toner-discharging opening (openings 2*b* and 1*b*) oriented in the wrong direction. Rotating the knob 4 through approximately 90 degrees, causes the ribs 4*a* and 4*c* to abut the projection 10 with the result that the knob 4 stops rotation thereof at a position as shown in FIG. 7B. At this stage, the inner pipe 2 is in a positional relation as shown in FIG. 9B with the outer pipe 1. With the knob 4 at this rotational position, the openings 1*b* of the outer pipe 1, openings 2*b* of the inner pipe 2 and openings 16*a* of the receiving portion of the drum cartridge 7 are aligned with one another so that the toner is dumped from the inner pipe 2 into the drum cartridge 7.

In the present invention, simply turning the knob 4 provided only on one longitudinal end of the inner pipe, permits mounting of the toner cartridge 6 into the receiving portion 16 and discharging of the toner into the drum cartridge 7. Thus, the invention provides a simple mounting operation of the toner cartridge. Further, the toner cartridge/drum cartridge construction is such that the inner pipe 2 stops rotation thereof at a position where the openings 2*b* are in alignment with the openings 1*b* of the outer pipe 1. This construction ensures discharge of toner from the toner cartridge 6 into the drum cartridge 7.

The resilient cap 5 having the same outer diameter as the outer pipe 1 is fitted over the flanges 2*a* with a snap action and prevents pull-out of the outer pipe 1 from the inner pipe 2. This construction reduces the number of parts and ensures sealing effect at the toner-filling opening.

The cap 5 may be made of a transparent material and graduated as shown in FIG. 5B with a plurality of lines so that the amount of toner contained in the toner cartridge 6 can be visually inspected.

Figure 9C:
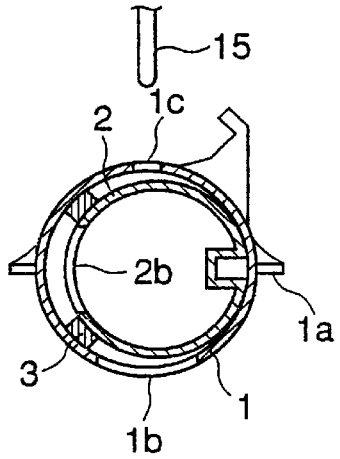
FIGS. 9C–9D illustrate the relative rotational positions of modified inner an outer pipes.
Figure 9D:
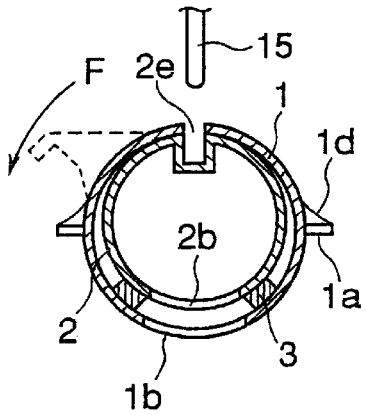

The toner cartridge 6 may be constructed to have a recess 2*e* in the inner pipe 2 and a hole 1*c* in the outer pipe 1 as shown in FIGS. 9C–9D so that the the recess 2*e* is in alignment with the hole 1*c* only when the the knob 4 is fully rotated to the position shown in FIG. 7B. A pin 15 may be provided on the lid 70 of the electrography recording apparatus at such a position that the pin 15 enters the recess 2*e* through the hole 1*c* when the lid 70 is closed after discharge of toner into the drum cartridge 7. This construction prevents the user from inadvertently closing the lid 70 with the knob 4 left between the two extreme ends of rotation thereof.

Figure 5D:
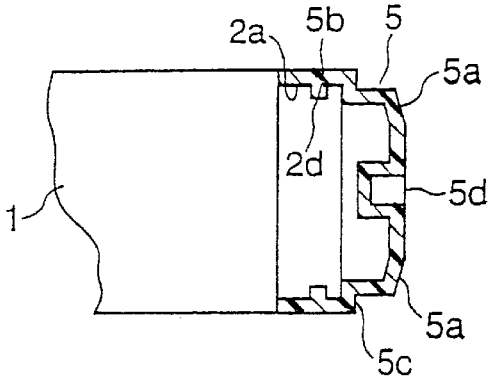
FIG. 5D is a cross-sectional view of the cap having a recess.
Figure 8C:
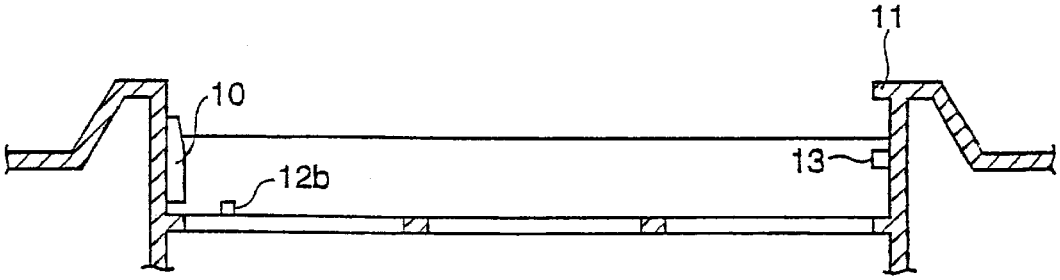
FIG. 8C illustrates a modification of the drum cartridge in FIG. 8A.

The drum cartridge 7 contains toner therein and therefore is preferably held horizontal when taking out from the electrography recording apparatus. The center of gravity of the drum cartridge 7 is not always at an equal distance M/2 from left and right ends thereof and therefore the drum cartridge may be preferably provided with an arrow 7*b* indicative of the center of gravity at which the user should hold the drum cartridge 7 by way of the handle 7*a* when lifting it from the electrography recording apparatus. The side wall 17*b* may be provided with a projection 13 as shown in FIG. 8C, and the cap 5 may be provided with a recess 5*d* as shown in FIG. 5D into which the projection loosely extends when the toner cartridge 6 is mounted into the receiving portion 16. The projection ensures rotation of the inner pipe 2 when discharging toner.

What is claimed is:

1. A toner cartridge comprising:

a generally cylindrical outer pipe having longitudinally opposed first and second end portions, the outer pipe having at least one first opening between said opposed end portions;

a generally cylindrical inner pipe inserted into said outer pipe, the inner pipe having longitudinally opposed third and fourth end portions and at least one second opening between the third and fourth end portions, the fourth end portion having a knob closing the fourth end portion, the knob rotating the inner pipe with respect to the outer pipe, the first opening being out of alignment with the second opening when the inner pipe is rotated to a first rotational position with respect to the outer pipe and being in alignment with the second opening when said inner pipe is rotated to a second rotational position; and a sealing member having at least one third opening in alignment with the second opening, the sealing member being mounted to the inner pipe surrounding the second opening to seal a gap between the outer pipe and the inner pipe;

wherein the inner pipe rotates eccentrically with respect to the outer pipe when the knob rotates with respect to the outer pipe, the third end portion has a first flange eccentric with respect to the inner pipe and a cap is fitted to the first flange, the first flange being annular in shape and being eccentric with respect to the inner pipe and concentric with respect to the outer pipe.

2. The toner cartridge according to claim 1, wherein the first flange is eccentric with respect to the inner pipe so that the first flange is away from the second opening by substantially a thickness of the sealing member between the first opening and the second opening.

3. A toner cartridge comprising:

a generally cylindrical outer pipe having longitudinally opposed first and second end portions, the outer pipe having at least one first opening between said opposed end portions; and a generally cylindrical inner pipe inserted into said outer pipe, the inner pipe having longitudinally opposed third and fourth end portions and at least one second opening between the third and fourth and portions, the fourth end portion having a knob closing the fourth end portion, the knob rotating the inner pipe with respect to the outer pipe, the first opening being out of alignment with the second opening when the inner pipe is rotated to a first rotational position with respect to the outer pipe and being in alignment with the second opening when said inner pipe is rotated to a second rotational position;

wherein the inner pipe rotates with respect to the outer pipe when the knob rotates with respect to the outer pipe;

and wherein the knob has a substantially radially projecting lever, the lever has at least an arrow indicative of one of a direction of rotation of the inner pipe relative to the outer pipe toward the first rotational position and a direction of rotation of the inner pipe relative to the outer pipe toward the second rotational position.

4. A toner cartridge comprising:

a generally cylindrical outer pipe having longitudinally opposed first and second end portions, the outer pipe having at least one first opening between the opposed end portions;

a generally cylindrical inner pipe inserted into the outer pipe, the inner pipe having longitudinally opposed third and fourth end portions and at least one second opening between the third and fourth end portions, the fourth end portion having a knob closing the fourth end portion, the knob rotating the inner pipe with respect to the outer pipe, the first opening being out of alignment with the second opening when the inner pipe is rotated to a first rotational position with respect to the outer pipe and being in alignment with the second opening when the inner pipe is rotated to a second rotational position; and wherein the inner pipe has a shorter longitudinal dimension than a width of a print region of a printer, and the knob is away from the second opening by at least a distance substantially equal to a width of a sealing member between the knob and the second opening.

5. A toner cartridge comprising:

a generally cylindrical outer pipe having longitudinally opposed first and second end portions, the outer pipe having at least one first opening between said opposed end portions; and a generally cylindrical inner pipe inserted into the outer pipe, the inner pipe having longitudinally opposed third and fourth end portions and at least one second opening between the third and fourth end portions, the fourth end portion having a knob closing the fourth end portion, the knob rotating the inner pipe with respect to the outer pipe, the first opening being out of alignment with the second opening when the inner pipe is rotated to a first rotational position with respect to the outer pipe and being in alignment with the second opening when the inner pipe is rotated to a second rotational position;

wherein the outer pipe has at least one flange projecting radially therefrom and the flange has at least one rib on one side thereof.

6. A toner cartridge comprising;

a generally cylindrical outer pipe having longitudinally opposed first and second end portions, the outer pipe having at least one first opening between the opposed end portions; and a generally cylindrical inner pipe inserted into the outer pipe, the inner pipe having longitudinally opposed third and fourth end portions and at least one second opening between the third and fourth end portions, the fourth end portion having a knob closing the fourth end portion, the knob rotating the inner pipe with respect to the outer pipe, the first opening being out of alignment with the second opening when the inner pipe is rotated to a first rotational position with respect to the outer pipe and being in alignment with the second opening when the inner pipe is rotated to a second rotational position;

wherein the knob has an outer circumferential surface and a circumferentially extending groove formed in the circumferential surface.

* * * * *